US010190530B2

(12) United States Patent
Mukohara

(10) Patent No.: US 10,190,530 B2
(45) Date of Patent: Jan. 29, 2019

(54) POWER UNIT

(71) Applicant: HONDA MOTOR CO., LTD., Tokyo (JP)

(72) Inventor: Hodaka Mukohara, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 91 days.

(21) Appl. No.: 15/440,203

(22) Filed: Feb. 23, 2017

(65) Prior Publication Data

US 2017/0276089 A1 Sep. 28, 2017

(30) Foreign Application Priority Data

Mar. 28, 2016 (JP) ..... 2016-063192

(51) Int. Cl.

| | |
|---|---|
| ***F02F 1/24*** | (2006.01) |
| ***B61G 1/02*** | (2006.01) |
| ***F01L 1/053*** | (2006.01) |
| ***F01L 1/18*** | (2006.01) |
| ***F02F 7/00*** | (2006.01) |
| ***F01L 1/047*** | (2006.01) |

(Continued)

(52) U.S. Cl.

CPC ..... *F02F 1/242* (2013.01); *B61G 1/02* (2013.01); *F01L 1/047* (2013.01); *F01L 1/053* (2013.01); *F01L 1/12* (2013.01); *F01L 1/18* (2013.01); *F01L 1/181* (2013.01); *F01L 1/26* (2013.01); *F02F 7/006* (2013.01); *F01L 2001/0535* (2013.01); *F01L 2105/00* (2013.01); *F02F 2007/0063* (2013.01)

(58) Field of Classification Search

CPC .. B61G 1/02; F01L 1/047; F01L 1/053; F01L 1/12; F01L 1/18; F01L 1/181; F01L 1/26; F01L 2001/0535; F01L 2105/00; F02F 1/242; F02F 2007/0063; F02F 7/006

See application file for complete search history.

(56) References Cited

U.S. PATENT DOCUMENTS 4,538,561 A * 9/1985 Amemori ..... F01L 1/024 123/193.5
4,651,704 A * 3/1987 Sekiguchi ..... F01L 1/047 123/572

(Continued)

FOREIGN PATENT DOCUMENTS

JP 11-022549 A 1/1999

*Primary Examiner* — Mark A Laurenzi
*Assistant Examiner* — Wesley G Harris
(74) *Attorney, Agent, or Firm* — Squire Patton Boggs (US) LLP

(57) ABSTRACT

An engine power unit includes a crankcase, a cylinder body, and a cylinder head sequentially stacked and fastened with each other. A cam shaft holder is fastened to the cylinder head to rotatably support a cam shaft of an engine valve operating mechanism. A cylinder head cover covers the cylinder head and the cam shaft holder. Fastening bolts penetrate the cylinder head cover and the cam shaft holder to be screwed into the cylinder head. Pressing surfaces are formed on the inner surface of the cylinder head cover. The pressing surfaces are abutted against and press the cam shaft holder to the cylinder head. Thus, rigidity around the cylinder head is enhanced, and a weight reduction of the power unit is achieved.

6 Claims, 10 Drawing Sheets

(51) Int. Cl.
*F01L 1/12* (2006.01)
*F01L 1/26* (2006.01)

(56) References Cited

U.S. PATENT DOCUMENTS

| | | | | |
|---|---|---|---|---|
| 5,622,143 | A * | 4/1997 | Fuoss | F01L 1/053 123/54.4 |
| 2008/0295796 | A1* | 12/2008 | Dunsch | F01L 1/053 123/195 C |
| 2011/0119915 | A1* | 5/2011 | Sanbyakuda | F01L 1/047 29/888.011 |

* cited by examiner

POWER UNIT

TECHNICAL FIELD

The present invention relates to a power unit including an internal combustion engine and, more particularly to a structure of a cylinder head of a vehicle power unit.

BACKGROUND ART

With a structure of a cylinder head of a conventional engine power unit, a cylinder head cover is fastened to a cam shaft holder by stud bolts, and the cam shaft holder and the cylinder head are not in contact with each other. In this type of the power unit, the cylinder head and the associated members are necessarily of an increased weight to enhancement the rigidity around the cylinder head. Therefore, a further contrivance has been needed for weight reduction around the cylinder head.

PRIOR ART DOCUMENT

Patent Document

[Patent Document 1]
JP H 11-022549 A

SUMMARY OF THE INVENTION

Problem to be Solved by the Invention

The engine power unit according to the present invention has been invented to eliminate the above-described problem. It is an object of the present invention to provide a power unit that makes it possible to enhance the rigidity around a cylinder head and achieve a weight reduction, and consequently achieve a reduction in weight of the power unit as a whole.

Means for Solving the Problem

To attain the above object, according to the present invention, there is provided a power unit comprising: an internal combustion engine body including a crankcase, a cylinder body, and a cylinder head sequentially stacked and fastened together to be integral with each other; a cam shaft holder fastened and fixed to the cylinder head to rotatably support a cam shaft of a valve operating mechanism of the engine; and a cylinder head cover covering the cylinder head and the cam shaft holder; wherein: fastening members are provided to penetrate the cylinder head cover and the cam shaft holder to fasten the cylinder head cover and the cam shaft holder to the cylinder head; and pressing surfaces are formed on an inner surface of the cylinder head cover, the pressing surfaces abutting against the cam shaft holder to press the cam shaft holder to the cylinder head.

According to the above-described constitution, the cam shaft holder is reinforced by the cylinder head cover, and the rigidity of the cylinder head is enhanced. It is therefore possible to achieve reduction in weight around the cylinder head, and thus achieve a weight reduction of the entire power unit.

In a preferred embodiment of the invention, the cylinder head cover are formed with fastening bolt boss portions through which the fastening member are inserted, and the pressing surfaces are formed by boss seat formed on the fastening bolt boss portions.

According to the above-described constitution, it is possible, by utilizing lower parts of the boss seats, to enhance a mutually supporting and reinforcing effect of the cylinder head cover and the cam shaft holder. Thus, a further weight reduction around the cylinder head can be achieved.

In a preferred embodiment of the invention, the valve operating mechanism includes a rocker arm supporting pins pivotably supporting rocker arms to be swung by the cam shaft for operating an engine valve; the cam shaft holder supports the rocker arm supporting pins; and the fastening bolt boss portions of the cylinder head cover are disposed on both sides of axes of the rocker arm supporting pins.

According to the above-described constitution, the fastening bolt boss portions are disposed so as to straddle the axes of the rocker arm supporting pins. Thus, the fastening bolt boss portions are located on both sides of the rocker arm supporting pins to fix the cam shaft holder. The cam shaft holder can therefore be reinforced effectively.

In a further preferred embodiment of the invention, the fastening bolt boss portions are arranged to surround a spark plug provided in the cylinder head so as to be directed to a center region of a cylinder bore.

According to the above-described constitution, it is possible to compensate for a decrease in rigidity due to existence of a clearance for the spark plug.

In a still further preferred embodiment of the invention, the cylinder head cover has reinforcing ribs connecting the fastening bolt boss portions to each other.

According to the above-described constitution, the reinforcing ribs further improve the rigidity of both the cylinder head cover and the cam shaft holder.

In a preferred form of the invention, the reinforcing ribs are arranged to surround a plug hole formed in the cylinder head cover for the spark plug.

According to the above-described constitution, the rigidity of the cylinder head cover and the cam shaft holder can be further increased.

In a preferred form of the invention, the fastening bolt boss portions of the cylinder head cover extend to a height above the plug hole.

According to the above-described constitution, it is possible to enhance rigidity around the periphery of the plug hole, and increase the rigidity of the cylinder head cover and the cam shaft holder.

In a preferred form of the invention, the cam shaft holder includes a cover wall portion covering the cam shaft from above and rocker arm clearance portions formed in the cover wall portion to avoid the rocker arms.

According to the above-described constitution, while miniaturizing the periphery of the cylinder head by bringing the rocker arms closer to the cam shaft holder, it is possible to enhance a reinforcing effect of the cover wall and achieve a weight reduction.

In a further preferred form of the invention, the cylinder head is fastened to the crankcase by flange bolts penetrating the cylinder body.

According to the above-described constitution, the cylinder head fastening bolt can be shortened owing to the reinforcing effect around the cylinder head, so that a reduction in weight around the cylinder head can be achieved.

Effect of the Invention

The power unit according to the present invention makes it possible to enhance rigidity around the cylinder head and achieve a weight reduction, and consequently achieve a reduction in weight of the entire power unit.

MODE FOR CARRYING OUT THE INVENTION

Figure 4:
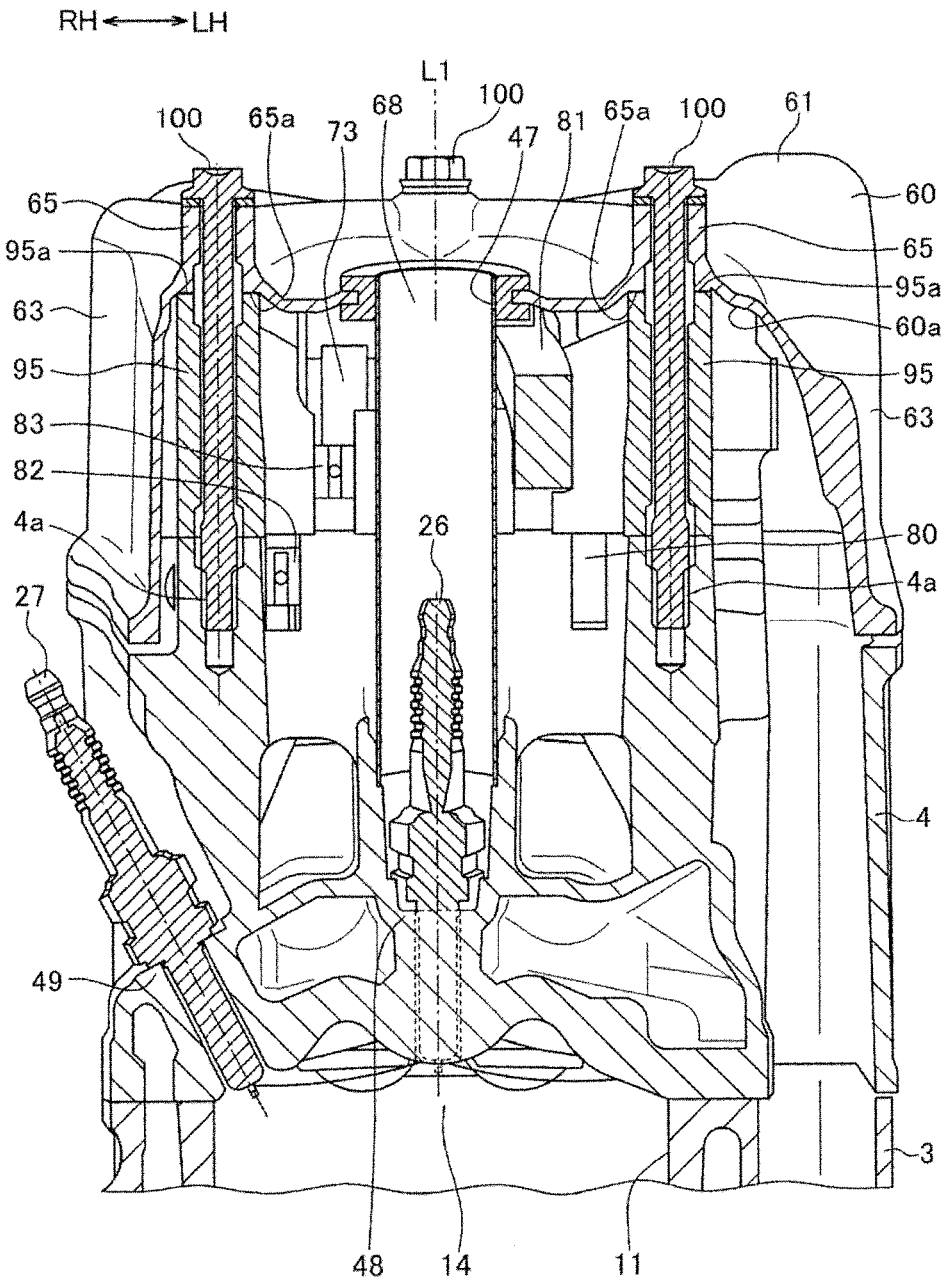
FIG. 4 is an enlarged vertical sectional view showing an essential part of the power unit sectioned along the cylinder axis.
Figure 5:
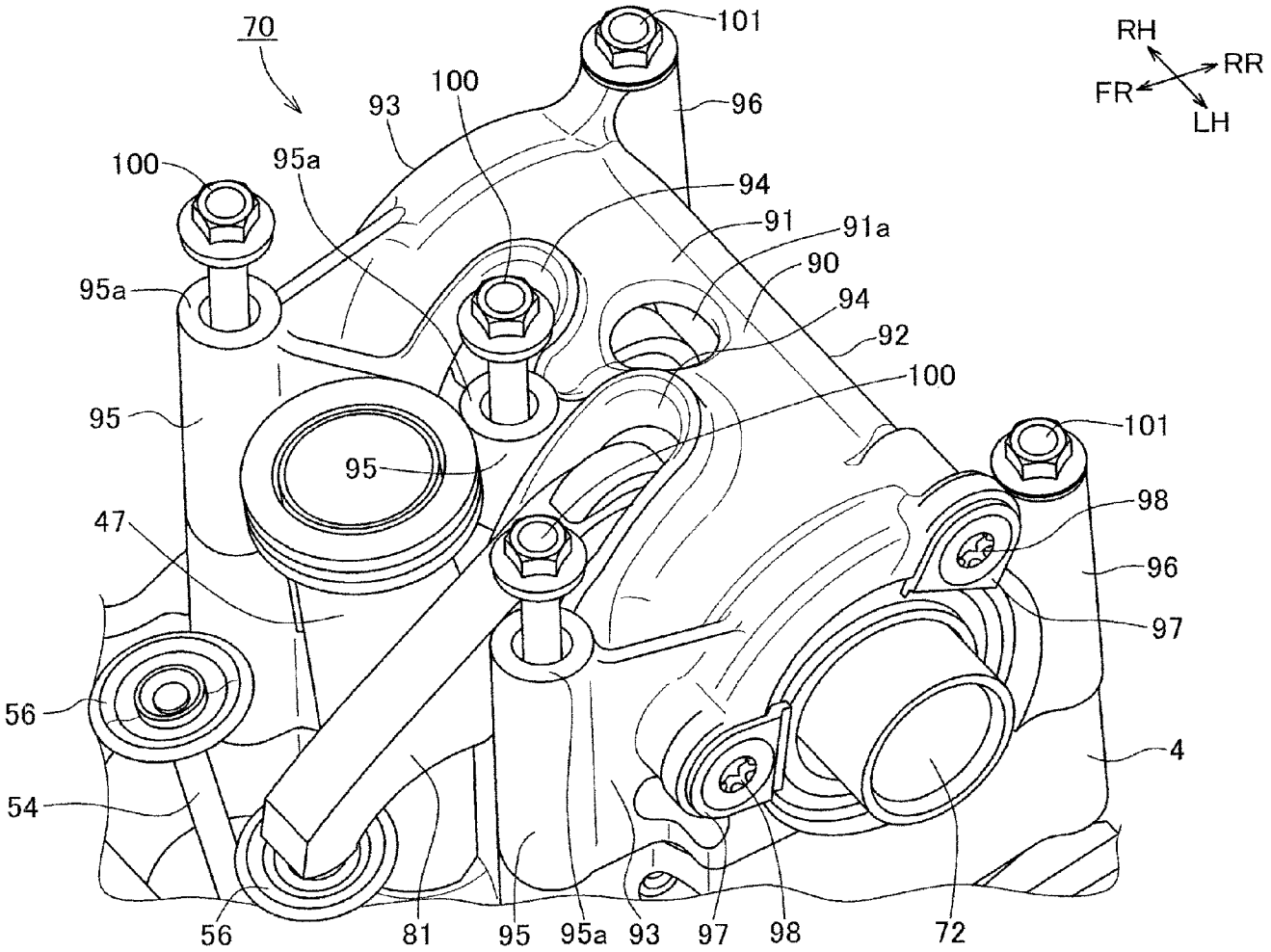
FIG. 5 is a perspective view of an upper portion of the power unit, with a head cover and one rocker arm omitted.
Figure 6:
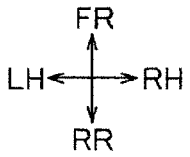
FIG. 6 is a view of the power unit in FIG. 5 as viewed in the direction of the cylinder axis.
Figure 6:
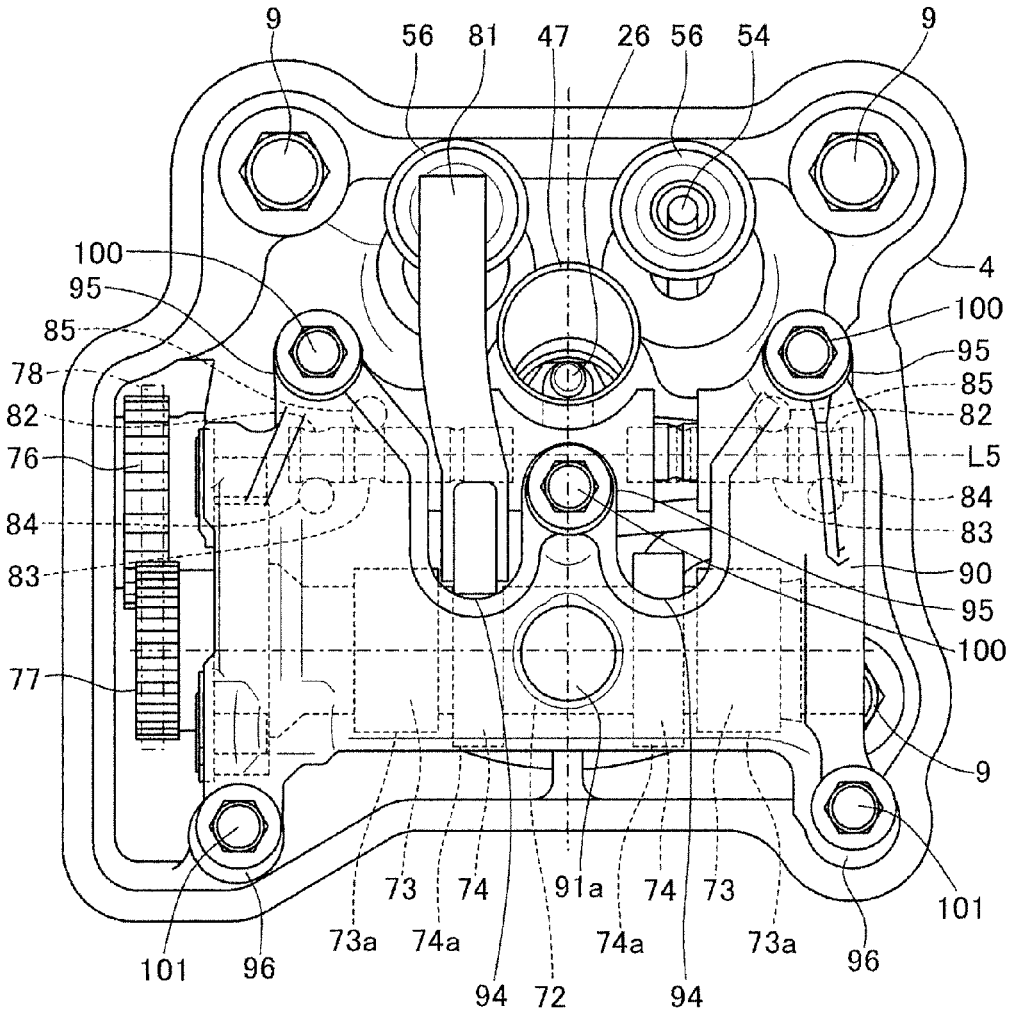

A power unit according to one embodiment of the present invention will hereinafter be described with reference to the drawings. The present power unit 1 integrally includes a transmission (not shown) in the rear of an internal combustion engine E, and is mounted on a motorcycle not shown in the figures. In FIGS. 4, 5 and 6, one of exhaust rocker arms is omitted, and in FIGS. 5 and 6, a head cover is further omitted. In the present embodiment, a forward direction, a rearward direction, a left direction, and a right direction are in accordance with the normal standard in which a straight-ahead traveling direction of the motorcycle with the power unit mounted thereon according to the present embodiment is a forward direction. In the drawings, FR denotes the forward direction, RR denotes the rearward direction, LH denotes the left direction, and RH denotes the right direction.

Figure 1:
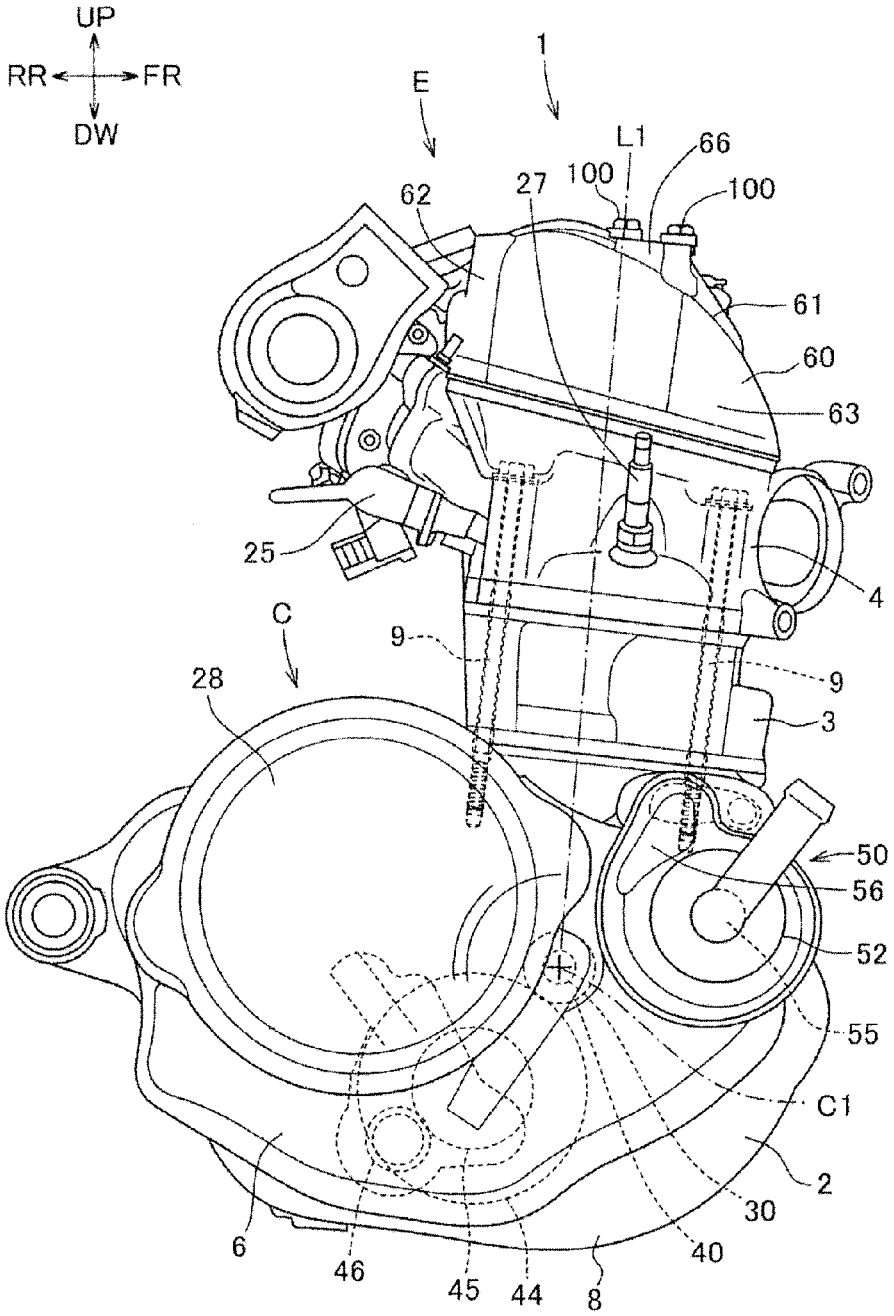
FIG. 1 is a left side view showing a power unit according to one embodiment of the present invention.
Figure 2:
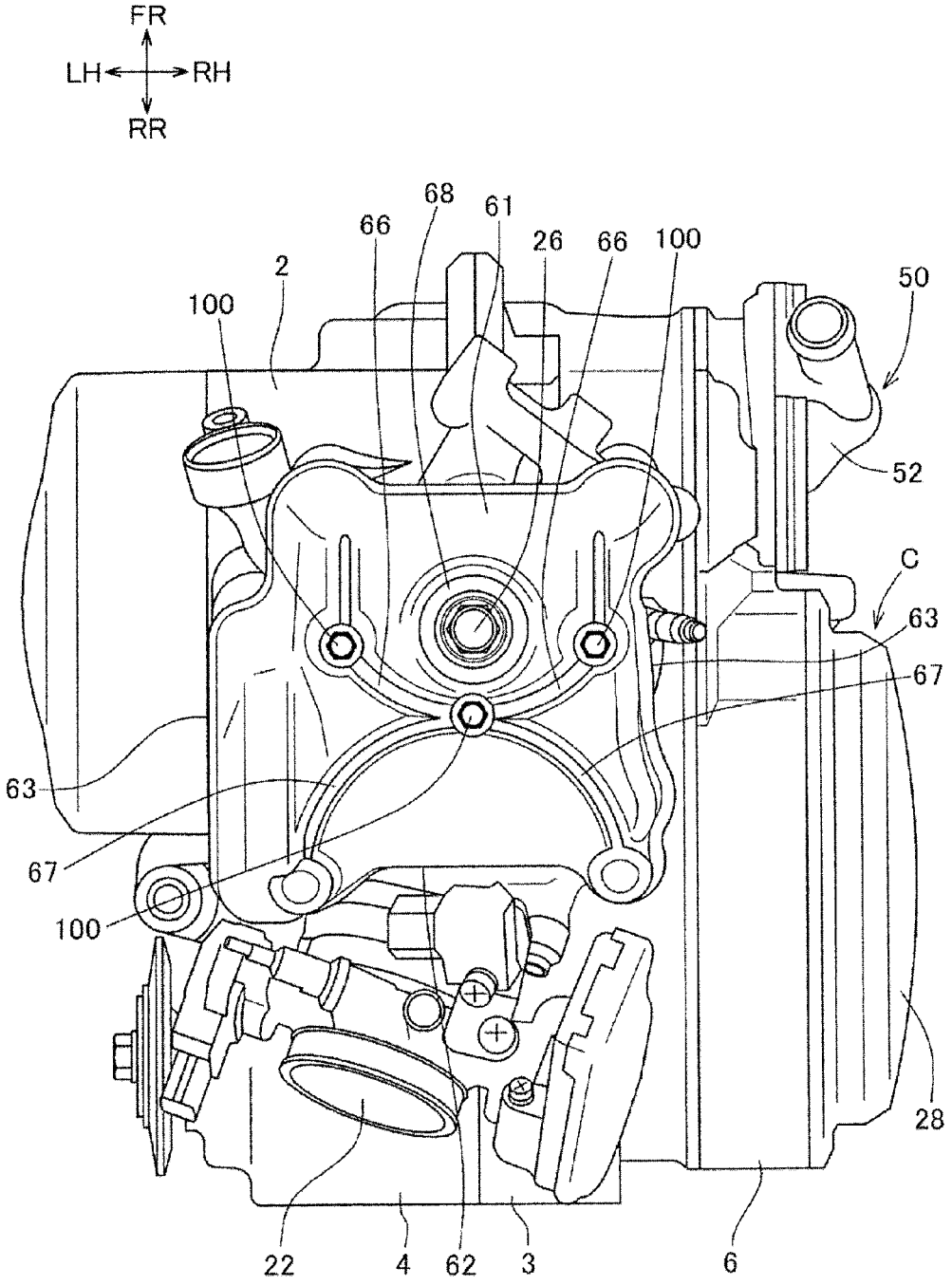
FIG. 2 is a view of the power unit in FIG. 1 as viewed in the direction of a cylinder axis.
Figure 3:
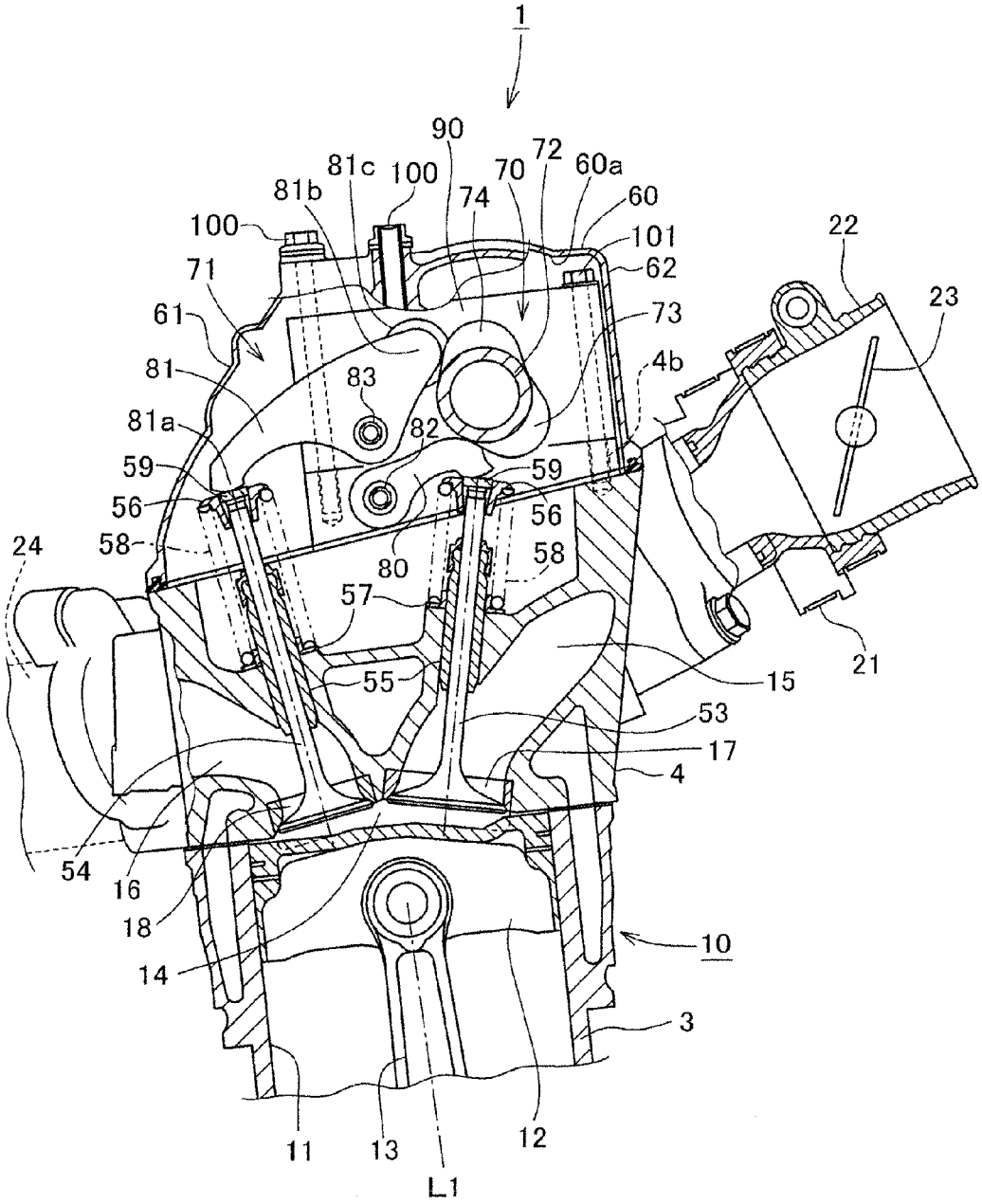
FIG. 3 is an enlarged vertical sectional view showing an essential part of the power unit.

The power unit 1 according to one embodiment of the present invention uses a water-cooled single-cylinder four-stroke internal combustion engine E. As shown in FIGS. 1 and 2, the power unit 1 includes a crankcase 2 formed of two left and right divided parts. A cylinder body 3, in which a cylinder is provided, and a cylinder head 4 are sequentially stacked upward on the crankcase 2. The crankcase 2, the cylinder body 3, and the cylinder head 4 are fastened by flange bolts 9 so as to be integral with each other. The cylinder head 4 is fastened and fixed to the crankcase 2 by the flange bolts 9 together with only the cylinder body 3. As shown in FIG. 3, a cam shaft holder 90 that supports a cam shaft 72 is fastened and fixed on the cylinder head 4. The cylinder head 4 and the cam shaft holder 90 are covered by a cylinder head cover 60. Both left and right surfaces of the crankcase 2 are covered by a right case cover 6 and a left case cover not shown. An oil pan 8 is attached to a lower portion of the crankcase 2. To the outside of the right case cover 6 are attached a clutch cover 28 that covers a clutch C and a water pump cover 52 that constitutes a part of a water pump 50. The power unit 1 is mounted on the motorcycle not shown in the figures in an attitude in which a crankshaft 30 is oriented in a vehicle width direction and a cylinder axis L1 of the cylinder is slightly inclined forward.

As shown in FIG. 3, the cylinder body 3 is provided with a single cylinder 10. A cylinder bore 11 that penetrates in an upward-downward direction is formed in the cylinder body 3. A piston 12 is fitted within the cylinder bore 11. The piston 12 is coupled via a connecting rod 13 to a crank pin (not shown) of the crankshaft 30 rotatably supported by the crankcase 2.

The crankshaft 30 is provided with a pair of crank webs (not shown) on both sides of the crank pin. The sectional shapes of the crank webs in the axial direction of the crankshaft 30 are each formed in an H-shape. By securing a section modulus, the crankshaft 30 has light weight and ensures coupling rigidity of the crank pin and a journal.

A combustion chamber 14 is formed between the cylinder head 4 and the piston 12. An intake port 15 and an exhaust port 16 are provided in the cylinder head 4. The intake port 15 communicates with the combustion chamber 14 via a pair of intake valve ports 17. The exhaust port 16 communicates with the combustion chamber 14 via a pair of exhaust valve ports 18. Further, intake valves 53 and exhaust valves 54 that open and close the intake valve ports 17 and the exhaust valve ports 18, respectively, are arranged in the cylinder head 4. The intake valves 53 and the exhaust valves 54 are opened and closed at predetermined timings by a valve gear or valve operating mechanism 70 disposed within the head cover 60.

The intake valves 53 and the exhaust valves 54 are arranged so as to move upward to open in an intake direction and in an exhaust direction, respectively, away from the combustion chamber 14. As shown in FIG. 3, the intake valves 53 and the exhaust valves 54 are each slidably inserted in valve guides 55 press-fitted in the cylinder head 4, and are each constantly biased in a valve closing direction by the elastic force of a spring 58 disposed in a compressed state between an upper retainer 56 and a lower retainer 57.

An intake pipe 21 and an exhaust pipe 24 are connected to the intake port 15 and the exhaust port 16, respectively. The intake pipe 21 is provided with a fuel injection valve 25, as shown in FIG. 1, for injecting fuel toward the intake port 15. Air sucked from the intake port 15 and the fuel injected from the fuel injection valve 25 are mixed with each other, and are fed into the combustion chamber 14.

As shown in FIG. 3, a throttle body 22 internally provided with a butterfly throttle valve 23 is connected to the intake pipe 21. The internal bore of the throttle body 22 cooperating with the throttle valve 23 is formed in such a shape that the internal diameter of the bore is gradually decreased toward the intake pipe 21. Therefore, a swirl easily occurs in a low-load range of the internal combustion engine E, so that combustion efficiency is improved.

As shown in FIG. 4, two spark plugs for igniting the mixture of fuel and air are screwed in the cylinder head 4. A first spark plug 26 is inserted in a spark plug tube 47 from above the combustion chamber 14 in the direction of the cylinder axis L1. The second spark plug 27 is inserted from a right side of the cylinder head 4. The cylinder head 4 is provided with a first spark plug boss seat 48 and a second spark plug boss seat 49. The first spark plug 26 is screwed in the first spark plug boss seat 48. The second spark plug 27 is screwed in the second spark plug boss seat 49. The first spark plug 26 and the second spark plug 27 are each attached to the cylinder head 4 so as to directed to the combustion chamber 14. Combustion energy produced in the combustion chamber 14 of the engine E is converted into kinetic energy of the piston 12. The piston 12 is thus moved up and down, so that the crankshaft 30 is driven in rotation via the connecting rod 13.

As shown in FIG. 3, the valve gear or valve operating mechanism 70 for performing operations of opening and closing the intake valves 53 and the exhaust valves 54, is disposed in a valve chamber 71 formed within the cylinder head 4 and the head cover 60. A single-overhead-camshaft (SOHC) type of a rocker arm system is adopted as the valve gear 70. The intake valves 53 and the exhaust valves 54 are driven by the valve gear 70 to open and close the intake port 15 and the exhaust port 16 opening into the combustion chamber 14 in synchronism with engine rotation.

Figure 8:
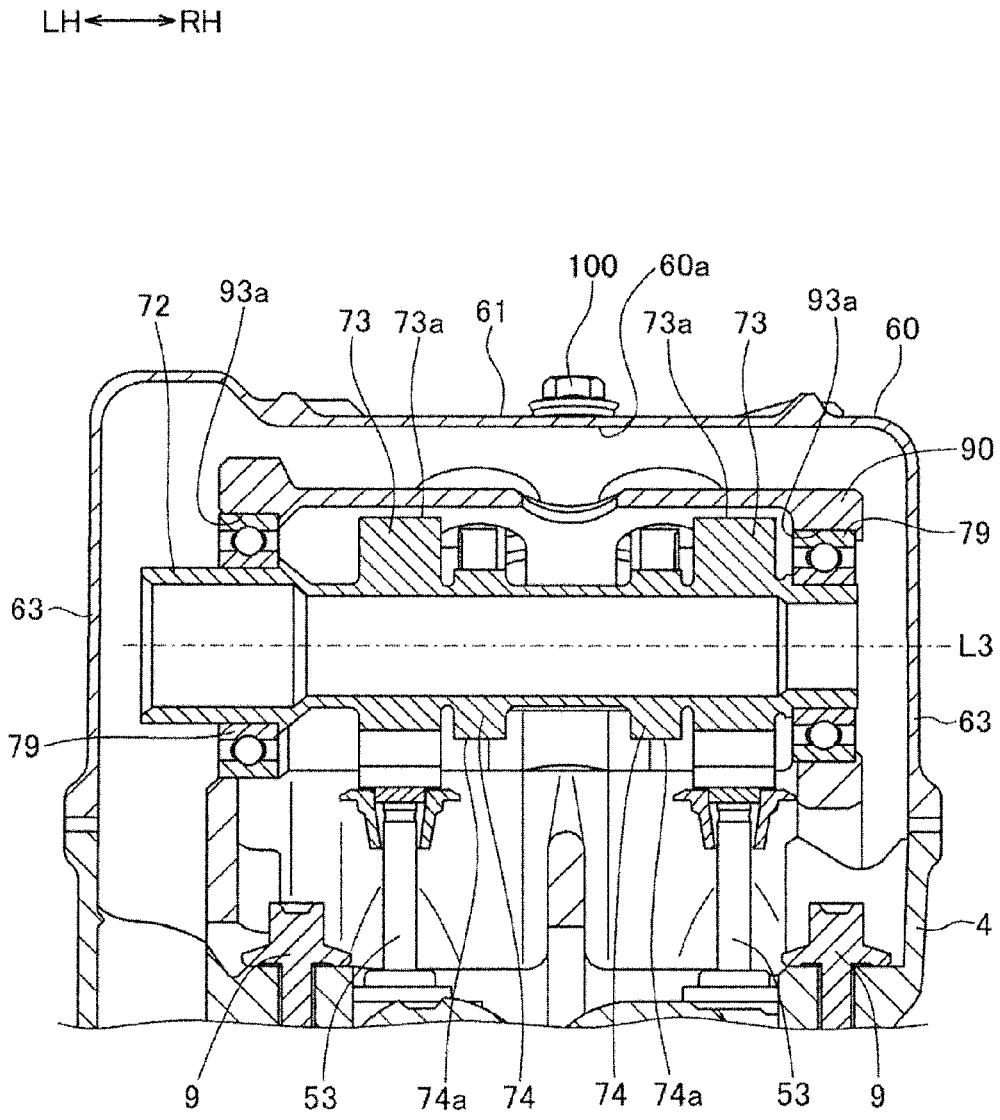
FIG. 8 is a sectional view taken along a line VIII-VIII of FIG. 7 in the direction of the arrows.

As shown in FIGS. 3 and 8, the valve gear 70 includes the cam shaft 72 provided with a pair of intake cams 73 corresponding to the pair of intake valves 53 and a pair of exhaust cams 74 corresponding to the pair of exhaust valves 54. Both left and right ends of the cam shaft 72 are rotatably supported by the cylinder head 4 and the cam shaft holder 90 via bearings 79. As shown in FIG. 6, the cam shaft 72 is provided with a driven gear 77 such that the driven gear 77 rotates integrally with the cam shaft 72. An endless timing chain 78 is stretched between the driven gear 77 and a drive gear 76 attached to the crankshaft 30 so as to rotate integrally with the crankshaft 30. A power is transmitted from the crankshaft 30 to the cam shaft 72 via the drive gear 76, the endless timing chain 78, and the driven gear 77. As the crankshaft 30 rotates, the cam shaft 72 is rotated in synchronism with the crankshaft 30.

The pair of exhaust cams 74 is disposed in the axially central region of the cam shaft 72, and the intake cams 73 are disposed axially outward of the respective exhaust cams 74. The intake valves 53 and the exhaust valves 54 are disposed to extend from the combustion chamber 14 in radial arrangement to make angles relative to the cylinder axis L1. Thus, in correspondence with this, cam surfaces 73*a* of the intake cams 73 and cam surfaces 74*a* of the exhaust cams 74 are formed to have corresponding slopes or inclinations relative to the direction of a cam axis L3 of the cam shaft 72.

As shown in FIG. 3, respective intake rocker arms 80 are interposed between the cam surfaces 73*a* of the intake cams 73 and shaft end portions of the intake valves 53. As the cam shaft 72 rotates, the shaft end portions of the intake valves 53 are pressed via the intake rocker arms 80 and tappet shims 59 according to the contour of the cam surfaces 73*a* of the intake cams 73. The intake valves 53 are thus opened and closed at predetermined timings.

Respective exhaust rocker arms 81 are also interposed between the cam surfaces 74*a* of the exhaust cams 74 and shaft end portions of the exhaust valves 54. As the cam shaft 72 rotates, the shaft end portions 54*c* of the exhaust valves 54 are pressed via the exhaust rocker arms 81 and tappet shims 59 according to the contour of the cam surfaces 74*a* of the exhaust cams 74. The exhaust valves 54 are thus opened and closed at predetermined timings.

Figure 10:
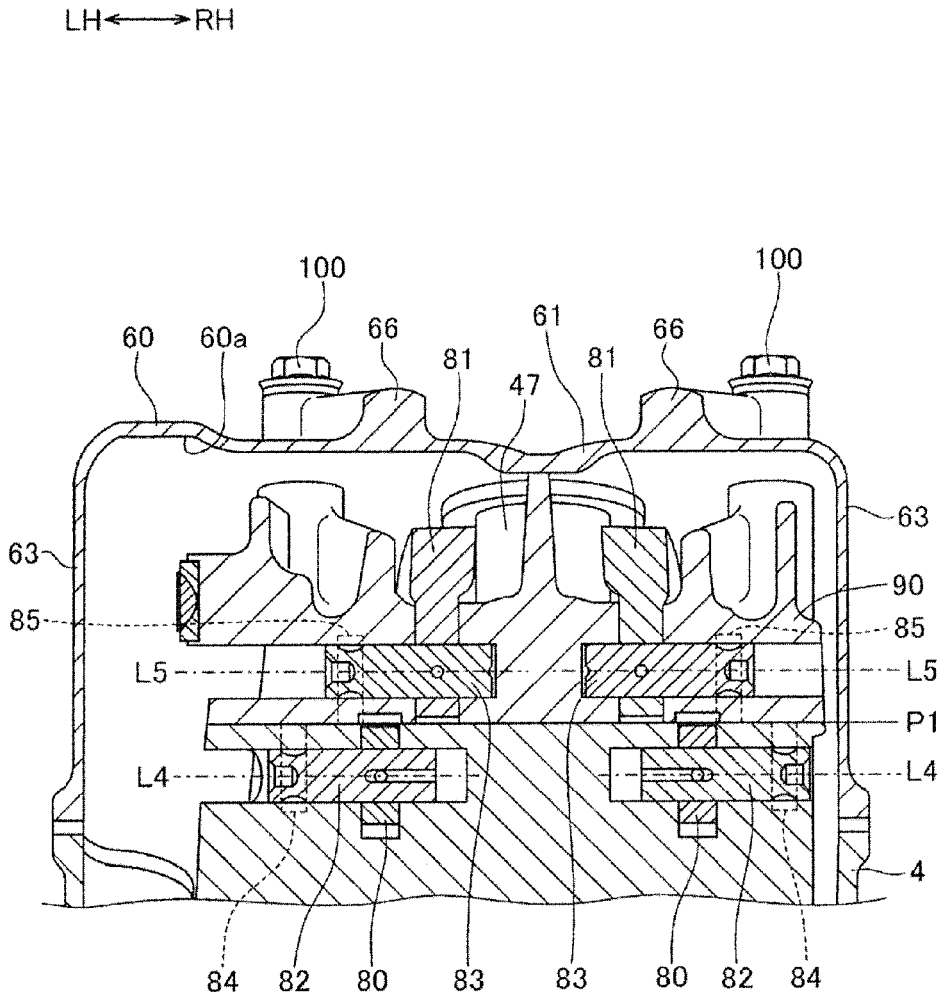
FIG. 10 is a sectional view taken along a line X-X of FIG. 7 in the direction of the arrows.

As shown in FIG. 10, the pair of intake rocker arms 80 is rotatably supported by a pair of intake rocker arm supporting pins 82 inserted in the cylinder head 4. Further, the pair of exhaust rocker arms 81 is rotatably supported by a pair of exhaust rocker arm supporting pins 83 inserted in the cam shaft holder 90. The intake rocker arm supporting pins 82 and the exhaust rocker arm supporting pins 83 play the role of pivot pins for the rocking motion. As shown in FIG. 3, the exhaust rocker arms 81 have their supporting pins 83 located between exhaust valve pressing portions 81*a* and exhaust cam abutment portions 81*b* of the exhaust rocker arms 81. The exhaust cam abutment portions 81*b* rotatably support rollers 81*c* for abutment with the exhaust cams 74.

The intake rocker arm supporting pins 82 and the exhaust rocker arm supporting pins 83 are respectively positioned at respective predetermined positions by positioning pins 84 inserted in the cam shaft holder 90 and by positioning pins 85 inserted in the cylinder head 4. Further, as shown in FIG. 3, the intake rocker arm supporting pins 82 and the exhaust rocker arm supporting pins 83 are arranged in substantially overlapping positions as viewed in the direction of the cylinder axis L1.

As will be noted from FIG. 10, the positioning pins 84 and the positioning pins 85 are inserted perpendicularly to an abutment plane P1 between the cylinder head 4 and the cam shaft holder 90. The cam shaft holder 90 is made to abut against the positioning pins 84 for the intake rocker arm supporting pins 82 to prevent the positioning pins 84 from falling off. Similarly, the positioning pins 85 for the exhaust rocker arm supporting pins 83 are prevented from falling off by the abutment of the cam shaft holder 90 with the cylinder head 4 on the abutment plane P1. The intake rocker arm supporting pins 82 and the exhaust rocker arm supporting pins 83 support the intake rocker arms 80 and the exhaust rocker arms 81, respectively, such that the intake rocker arms 80 and the exhaust rocker arms 81 are so swung under control of the contour of the cam surfaces 73*a* of the intake cams 73 formed on the cam shaft 72 and the contour of the cam surfaces 74*a* of the exhaust cams 74 formed on the cam shaft 72.

Further, because the positioning pins 84 for the intake rocker arm supporting pins 82 and the positioning pins 85 for the exhaust rocker arm supporting pins 83 are disposed perpendicularly to the abutment plane P1 between the cylinder head 4 and the cam shaft holder 90, spaces for inserting the positioning pins 84 to be inserted into the cam shaft holder 90 and the positioning pins 85 to be inserted into the cylinder head 4 are secured.

The cam shaft holder 90 will be described below. As shown in FIG. 5, the cam shaft holder 90 includes: a cover wall portion 91 covering the cam shaft 72 from above; a rear wall portion 92 extending from a rear edge of the cover wall portion 91 to the cylinder head 4; and side wall portions 93 extending from both of left and right sides of the cover wall portion 91 to the cylinder head 4.

Both the left and right sides of the rear edge of the cover wall portion 91 are provided with holder fastening bolt boss portions 96 in which holder fastening bolts 101 are inserted. The holder fastening bolts 101 attach the cam shaft holder 90 to the cylinder head 4. As shown in FIG. 3, the cylinder head 4 has bolt holes 4*b* formed at positions corresponding to the holder fastening bolt boss portions 96. The holder fastening bolts 101 inserted through the holder fastening bolt boss portions 96 of the cam shaft holder 90 are screwed into the bolt holes 4*b*. The rear portion of the cam shaft holder 90 is thus fastened and fixed to the cylinder head 4.

As shown in FIGS. 5 and 6, both of the left and right sides of the front part of the cover wall portion 91 and a central part of the front portion are formed with fastening bolt boss portions 95 in which fastening bolts 100 are inserted. The fastening bolts 100 are inserted through the cylinder head cover 60 and the cam shaft holder 90 and fastened to the cylinder head 4. As shown in FIG. 6, which is a view seen in the direction of the cylinder axis L1, the left and right fastening bolt boss portions 95 are formed at positions aligned with the spark plug tube 47 in the left-right directions, and the central fastening bolt boss portion 95 is formed to be located at the rear of the spark plug tube 47. An opening 91*a* is formed at the rear of the central fastening bolt boss portion 95 of the cover wall portion 91. The opening 91*a* supplies lubricant oil dropping from the cylinder head cover 60 to the cam shaft 72 to be described later.

Further, rocker arm clearance portions 94 for avoiding the exhaust rocker arms 81 are formed in the front portion of the cover wall portion 91 so as to be located on the left and right of the central fastening bolt boss portion 95. As viewed in the direction of the cylinder axis L1, rear ends of the rocker arm clearance portions 94 are formed in the shape of a recess, so as to be located slightly rearward of the cam surfaces 74*a* of the exhaust cams 74 on the cam shaft 72 so as not to obstruct swinging of the exhaust cam abutment portions 81*b* and the rollers 81*c* of the exhaust rocker arms 81.

As shown in FIGS. 5 and 8, cam shaft insertion holes 93*a* into which the cam shaft 72 is inserted are formed in the side wall portions 93 on both the left and right sides of the cam shaft holder 90. The cam shaft 72 inserted in the cam shaft insertion holes 93*a* is supported by the cam shaft holder 90 via the bearings 79. As shown in FIG. 5, a pair of retaining pieces 97 abuts against the left end portion of the cam shaft 72. The retaining pieces 97 are screwed onto the side wall portion 93 on the left side of the cam shaft holder 90 by nuts 98. The cam shaft 72 is thereby prevented from slipping off.

The cylinder head 4 and the cam shaft holder 90 are covered by the cylinder head cover 60 as shown in FIGS. 1 and 3.

The cylinder head cover 60 includes: a cover wall portion 61 covering the cylinder head 4 and the cam shaft holder 90 from above and so as to extend frontward; a rear wall portion 62 extending from the rear end of the cover wall portion 61 to the cylinder head 4; and side wall portions 63 extending from both the left and right sides of the cover wall portion 61 to the cylinder head 4.

Figure 7:
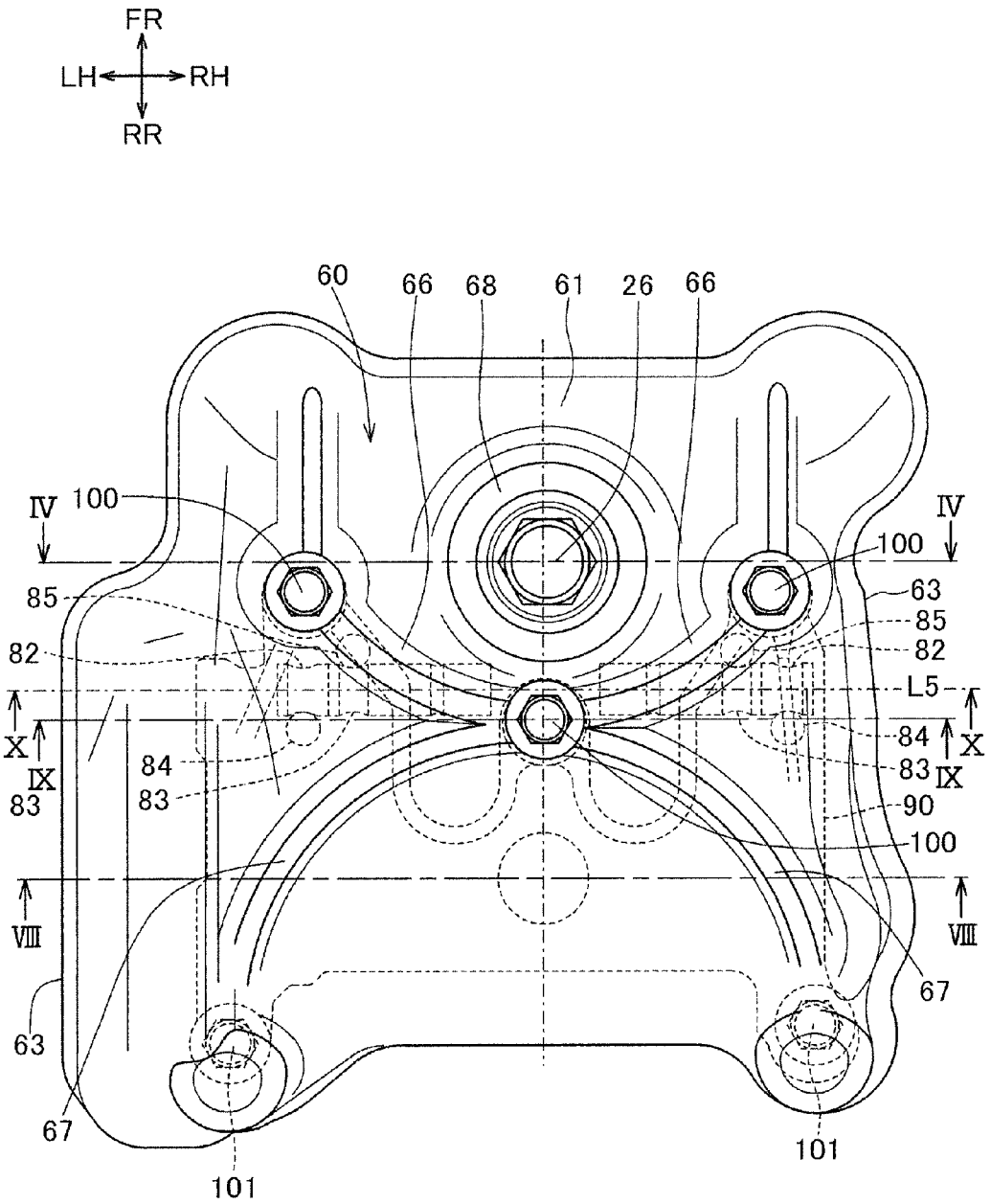
FIG. 7 is a diagram showing a state in which the head cover is attached to the power unit in FIG. 6.

As FIG. 7 shows, the cover wall portion 61 of the cylinder head cover 60 is provided with a plug hole 68 through which the first spark plug 26 is inserted. The first spark plug 26 is disposed in the cylinder head 4 so as to be directed to the vicinity of the center of the cylinder bore 11 from above. The spark plug tube 47 is attached to the plug hole 68 in the direction toward the cylinder head 4.

As FIG. 4 shows, the cover wall portion 61 has fastening bolt boss portions 65 disposed at positions corresponding to the fastening bolt boss portions 95 of the cam shaft holder 90 as viewed in the direction of the cylinder axis L1. As will be noted from FIG. 7, the fastening bolt boss portions 65 are located on both the left and right sides of the plug hole 68 and at a center region in the rear of the plug hole 68. Thus, the fastening bolt boss portions 65 are arranged so as to surround the plug hole 68. The fastening bolt boss portions 65 on the left and the right and the fastening bolt boss portion 65 at the center are so disposed, as will be noted from FIG. 7, that these boss portion 65 are on the opposite sides of an axis L4 of the intake rocker arm supporting pins and an axis L5 of the exhaust rocker arm supporting pins, as viewed in the direction of the cylinder axis L1. Further, as shown in FIG. 4, the fastening bolt boss portions 65 extend to a height above the plug hole 68.

Figure 9:
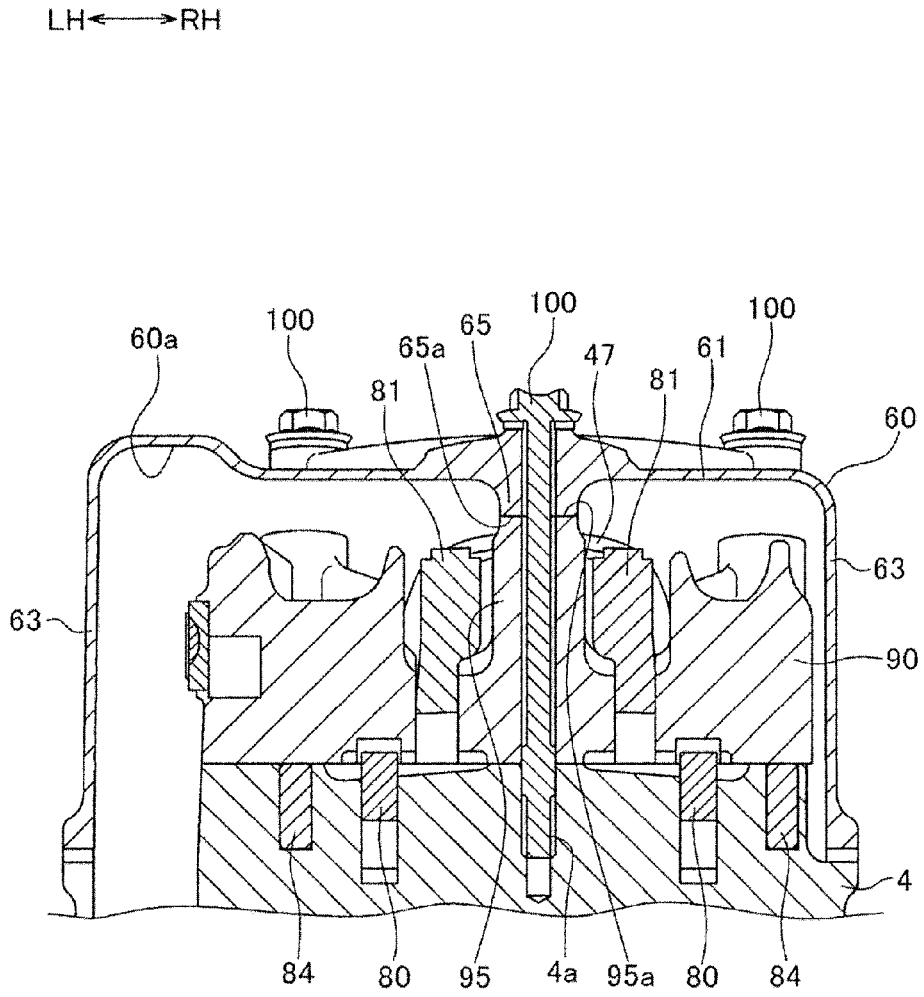
FIG. 9 is a sectional view taken along a line IX-IX of FIG. 7 in the direction of the arrows.

As shown in FIGS. 4 and 9, the fastening bolt boss portions 65 extend from the inner surface 60*a* of the cylinder head cover 60 to the fastening bolt boss portions 95 of the cam shaft holder 90. The fastening bolt boss portions 65 are formed to have such a length that their inner end surfaces forming boss seats 65*a* abut against boss seats 95*a* of the fastening bolt boss portions 95 of the cam shaft holder 90. The boss seats 65*a* function as pressing surfaces which abut against and downwardly press the cam shaft holder 90.

Further, as shown in FIG. 7, a reinforcing rib 66 that connects the fastening bolt boss portion 65 on the left side and the fastening bolt boss portion 65 at the center to each other, is formed on the surface of the cover wall portion 61 of the cylinder head cover 60. The fastening bolt boss portion 65 on the right side and the fastening bolt boss portion 65 at the center are also provided with a reinforcing rib 66 that connects the fastening bolt boss portion 65 on the right side and the fastening bolt boss portion 65 at the center to each other. These reinforcing ribs 66 are formed in the shape of an arc so as to surround the plug hole 68 of the spark plug 26. In addition, ribs 67 in the shape of an arc are also formed so as to connect the fastening bolt boss portion 65 at the center to each of left and right sides of the rear edge of the cover wall portion 61 of the cylinder head cover 60.

The cylinder head cover 60 and the cam shaft holder 90 are configured as described above and attached to the cylinder head 4 as follows. The cam shaft holder 90 is mounted on the top surface of the cylinder head 4. The holder fastening bolts 101 are inserted through the holder fastening bolt boss portions 96 of the cam shaft holder 90, and are screwed into the bolt holes 4*b* of the cylinder head 4. The intake port side of the cam shaft holder 90 is thereby fixed to the cylinder head 4. Thereafter, the cylinder head cover 60 is mounted so as to cover the cylinder head 4 and the cam shaft holder 90. The fastening bolts 100 as fastening members are inserted through the fastening bolt boss portions 65 of the cylinder head cover 60 and the fastening bolt boss portions 95 of the cam shaft holder 90, and are screwed into bolt holes 4*a* arranged in the cylinder head 4. Then, the boss seats 65*a* of the fastening bolt boss portions 65 of the cylinder head cover 60 are pressed against the boss seats 95*a* of the fastening bolt boss portions 95 of the cam shaft holder 90. The cylinder head cover 60 therefore presses the cam shaft holder 90 to the cylinder head 4. The cylinder head cover 60 and the cam shaft holder 90 are thus integrally and securely fixed to the cylinder head 4 at the same time.

The power unit 1 according to the present embodiment is configured as described above, and therefore produces the following effects.

The power unit 1 includes: a crankcase 2, a cylinder body 3, and a cylinder head 4 sequentially stacked and fastened so as to be integral with each other; a cam shaft holder 90 fastened and fixed to the cylinder head 4, the cam shaft holder 90 supporting a cam shaft 72; a head cover 60 covering the cylinder head 4 and the cam shaft holder 90; and a fastening bolt 100 penetrating the head cover 60 and the cam shaft holder 90 and fastened to the cylinder head 4; a pressing surface 65*a* being formed on an inner surface 60*a* of the head cover 60, the pressing surface 65*a* abutting against the cam shaft holder 90 and pressing the cam shaft holder 90 to the cylinder head 4 side. Thus, the cam shaft holder 90 is reinforced by the head cover 60, the rigidity of the cylinder head 4 can be enhanced, and lighter weight around the cylinder head 4 can be achieved, so that a reduction in weight of the power unit as a whole can be achieved.

In addition, the pressing surface 65*a* is formed by a boss seat 65*a* of a fastening bolt boss portion 65 of the head cover 60 through which the fastening bolt 100 is inserted. Thus, by utilizing a part directly below the boss seat 65*a* of the fastening bolt boss portion 65, it is possible to enhance a mutual reinforcing effect of the head cover 60 and the cam shaft holder 90. A further weight reduction around the cylinder head 4 can therefore be achieved.

The cam shaft holder 90 supports an exhaust rocker arm supporting pin 83 rotatably supporting an exhaust rocker arm 81, and a plurality of fastening bolt boss portions 65 are disposed so as to straddle an exhaust rocker arm supporting pin axis L5 of the exhaust rocker arm 81. Thus, the fastening bolt boss portions 65 are located on both of the intake side and exhaust side of the exhaust rocker arm supporting pin 83, and the cam shaft holder 90 is fixed to the cylinder head 4 by the fastening bolts 100. The cam shaft holder 90 can therefore be reinforced effectively.

The fastening bolt boss portions 65 are arranged so as to surround a first spark plug 26 that is disposed in the cylinder head 4 so as to face a vicinity of a center of a cylinder bore 11 from above. It is thus possible to compensate for an amount of decrease in rigidity which decrease is attendant on a clearance for the first spark plug 26.

Reinforcing ribs 66 that connect the fastening bolt boss portions 65 to each other are formed on the head cover 60. Thus, the reinforcing ribs 66 arranged on the head cover 60 can further improve the mutual rigidity of the head cover 60 and the cam shaft holder 90.

The reinforcing ribs 66 are formed so as to surround a plug hole 68 of the first spark plug 26. Thus, the mutual rigidity of the head cover 60 and the cam shaft holder 90 can be improved more.

The fastening bolt boss portions 65 of the head cover 60 extend to a height above an upper end of the plug hole 68. It is thus possible to enhance rigidity around the periphery of the plug hole 68, and more enhance the rigidity of the head cover 60 and the cam shaft holder 90.

The cam shaft holder 90 includes a cover wall portion 91 covering the cam shaft 72 from above and a rocker arm clearance portion 94 formed in the cover wall portion 91, the rocker arm clearance portion 94 avoiding the exhaust rocker arm 81. Thus, while miniaturizing the valve gear 70 on the periphery of the cylinder head 4 by bringing the exhaust rocker arm 81 closer to the cam shaft holder 90, it is possible to enhance a reinforcing effect of the cover wall portion 91 and achieve a weight reduction.

The cylinder head 4 is fastened to the crankcase 2 by a flange bolt 9 that penetrates the cylinder body 3. Thus, the cylinder head fastening bolt can be shortened owing to the reinforcing effect around the cylinder head 4, so that a reduction in weight around the head can be achieved.

An embodiment of the present invention has been described above in detail. However, the present invention is not limited to the foregoing embodiment, but is susceptible of various other changes. In addition, the power unit 1 according to the present invention is not only applicable to saddle riding type vehicles such as motorcycles and the like, but also widely applicable to other vehicles.

DESCRIPTION OF REFERENCE SYMBOLS

1 . . . Power unit, 2 . . . Crankcase, 3 . . . Cylinder body, 4 . . . Cylinder head, 9 . . . Flange bolt, 10 . . . Cylinder, 11 . . . Cylinder bore, 26 . . . First ignition plug, 30 . . . Crankshaft, 60 . . . Cylinder head cover, 60*a* . . . Inner surface, 65 . . . Fastening bolt boss portion, 68 . . . Plug hole, 72 . . . Cam shaft, 80 . . . Intake rocker arm, 81 . . . Exhaust rocker arm, 82 . . Intake rocker arm supporting pin, 83 . . . Exhaust rocker arm supporting pin, 90 . . . Cam shaft holder, 91 . . . Cover wall portion, 94 . . . Rocker arm clearance portion, 95 . . . Fastening bolt boss portion, 100 . . . Fastening bolt, E . . . Internal combustion engine, L1 . . . Cylinder axis, L2 . . . Crankshaft axis, L4 . . . Intake rocker arm supporting pin axis, L5 . . . Exhaust rocker arm supporting pin axis.

The invention claimed is:

1. A power unit comprising:

an internal combustion engine body including a crankcase, a cylinder body, and a cylinder head sequentially stacked and fastened together to be integral with each other;

a cam shaft holder fastened and fixed to the cylinder head to rotatably support a cam shaft of a valve operating mechanism of the engine; and a cylinder head cover covering the cylinder head and the cam shaft holder; wherein:

fastening members are provided to penetrate the cylinder head cover and the cam shaft holder to fasten the cylinder head cover and the cam shaft holder to the cylinder head;

pressing surfaces are formed on an inner surface of the cylinder head cover, the pressing surfaces abutting against the cam shaft holder to press the cam shaft holder to the cylinder head;

wherein the cylinder head cover is formed with fastening bolt boss portions through which the fastening members are inserted, and the pressing surfaces are formed by boss seats formed on the fastening bolt boss portions;

wherein the valve operating mechanism includes rocker arm supporting pins pivotably supporting rocker arms to be swung by the cam shaft for operating an engine valve, the cam shaft holder supports the rocker arm supporting pins, and the fastening bolt boss portions of the cylinder head cover are disposed on both sides of axes of the rocker arm supporting pins; and wherein the fastening bolt boss portions are arranged to surround a spark plug provided in the cylinder head so as to be directed to a center region of a cylinder bore in the cylinder body.

2. A power unit comprising:

an internal combustion engine body including a crankcase, a cylinder body, and a cylinder head sequentially stacked and fastened together to be integral with each other;

a cam shaft holder fastened and fixed to the cylinder head to rotatably support a cam shaft of a valve operating mechanism of the engine;

a cylinder head cover covering the cylinder head and the cam shaft holder; wherein:

fastening members are provided to penetrate the cylinder head cover and the cam shaft holder to fasten the cylinder head cover and the cam shaft holder to the cylinder head;

pressing surfaces are formed on an inner surface of the cylinder head cover, the pressing surfaces abutting against the cam shaft holder to press the cam shaft holder to the cylinder head;

wherein the cylinder head cover is formed with fastening bolt boss portions through which the fastening members are inserted, and the pressing surfaces are formed by boss seats formed on the fastening bolt boss portions; and wherein the cylinder head cover has reinforcing ribs connecting the fastening bolt boss portions to each other.

3. The power unit according to claim 2, wherein the reinforcing ribs are arranged to surround a plug hole formed in the cylinder head cover for the spark plug.

4. The power unit according to claim 3, wherein the fastening bolt boss portions of the cylinder head cover extend to a height above the plug hole.

5. The power unit according to claim 4, wherein the cam shaft holder includes a cover wall portion covering the cam shaft from above and rocker arm clearance portions formed in the cover wall portion to avoid the rocker arms.

6. The power unit according to claim 4, wherein the cylinder head is fastened to the crankcase by flange bolts penetrating the cylinder body.

* * * * *